United States Patent [19]

Dvoracek

[11] Patent Number: 4,719,001

[45] Date of Patent: Jan. 12, 1988

[54] ANTIFOULANT ADDITIVES FOR HIGH TEMPERATURE HYDROCARBON PROCESSING

[75] Inventor: Louis M. Dvoracek, Brea, Calif.

[73] Assignee: Union Oil Company of California, Los Angeles, Calif.

[21] Appl. No.: 844,462

[22] Filed: Mar. 26, 1986

[51] Int. Cl.[4] ..... C10G 9/16

[52] U.S. Cl. ..... 208/48 AA; 252/8.3; 585/950

[58] Field of Search ..... 208/48 AA, 48 R, 47; 585/950

[56] References Cited

U.S. PATENT DOCUMENTS

| | | | |
|---|---|---|---|
| 3,536,776 | 10/1970 | Lo | 585/636 |
| 3,553,101 | 1/1971 | Foroulis | 208/48 AA |
| 4,200,518 | 4/1980 | Mulvany | 208/48 AA |
| 4,259,175 | 3/1981 | McArthur | 208/113 |
| 4,297,150 | 10/1981 | Foster et al. | 148/6.3 |
| 4,318,799 | 3/1982 | Yoo | 208/114 |
| 4,431,514 | 2/1984 | Ferm | 208/48 AA |
| 4,444,649 | 4/1984 | Dvoracek | 208/48 AA |
| 4,545,893 | 10/1985 | Porter et al. | 208/48 R |
| 4,552,643 | 11/1985 | Porter et al. | 208/48 AA |
| 4,575,413 | 3/1986 | Pizzoni et al. | 208/48 AA |

*Primary Examiner*—Paul E. Konopka

*Attorney, Agent, or Firm*—Dean Sandford; Gregory F. Wirzbicki; Alan H. Thompson

[57] ABSTRACT

Fouling of metallic surfaces contacted with hydrocarbon oils at elevated temperatures is reduced by combining the oils with foulant-inhibiting amounts of thiadiazole compounds or triazole compounds, or aluminum compounds in combinations containing thiadiazole, triazole and acid compounds.

26 Claims, No Drawings

ANTIFOULANT ADDITIVES FOR HIGH TEMPERATURE HYDROCARBON PROCESSING

BACKGROUND OF THE INVENTION

1. Field of the Invention

The present invention relates to the reduction of fouling of hydrocarbon oil processing equipment. More particularly, the invention relates to an antifoulant additive composition, a hydrocarbon oil composition containing an antifoulant additive or combinations of additives and a method for using the additives for reducing fouling in oil processing equipment.

2. Description of the Prior Art

In processing various hydrocarbon oils, such as crude petroleum, shale oils, syncrude oils, oils from bituminous sands, and fractions thereof, including naphthas, middle distillate oils, gas oils, heavy vacuum gas oils, topped crudes, atmospheric or vacuum residual fractions, viscous pitches, and the like, or petrochemicals prepared from such oils, it is usually necessary to heat the hydrocarbon oil to an elevated temperature by contacting it with a heated metal surface, e.g., by flowing it through a heating device such as a tube and shell heat exchanger or through the tubes of a direct-fired heater. Many hydrocarbon oils, however, tend to foul metal surfaces with which they come in contact at elevated temperatures by depositing thereon solid or semi-solid materials, commonly called foulants, such as inorganic salts, oxides, coke, tars, polymers, and other carbonaceous matter. Such fouling materially reduces the efficiency of heat transfer from the metal surface to the oil, thereby increasing the amount of fuel required to heat the oil to the desired temperature. It also reduces the hydraulic capacity of the heat exchange equipment (thereby increasing the amount of energy required to pass the oil through the equipment) and in aggravated cases may render it impossible to maintain the desired flow rate. Consequently, hydrocarbon oil processing units must be periodically shut down and deposits removed or the units replaced. Such fouling of heat exchangers, and also equipment such as furnaces, pipes, reboilers, condensers, compressors, auxiliary equipment, and the like, is costly due to the loss of production time and the man-hours required for disassembly, cleaning and reassembly of unit process equipment components. The equipment is usually fabricated of carbon steel, stainless steel, chrome-steels, steel alloys, aluminum or other metallic materials.

A variety of materials has thus far been added to hydrocarbon oils to produce compositions that reduce fouling of heated surfaces and consequently increase heat transfer efficiency. Unfortunately, none of the materials thus far developed is successful in completely eliminating fouling-related difficulties in hydrocarbon processing operations. Consequently, efforts are continuing to effect even greater improvement in such operations to minimize, or preferably completely eliminate, fouling of heated surfaces.

It is, therefore, an object of this invention to provide a hydrocarbon oil composition that has a reduced tendency for fouling.

It is also an object of this invention to provide a method for preparing a hydrocarbon oil composition that has a reduced tendency for fouling.

Another object in this invention is to provide a hydrocarbon oil composition containing an additive that reduces the energy requirements of hydrocarbon processing equipment.

Yet another object is to provide a method for increasing the heat transfer efficiency in hydrocarbon processing equipment.

Still another object is to reduce the energy requirements for heated surfaces in contact with a hydrocarbon oil composition containing an additive or combination of additives.

These and other objects and advantages of the invention will become apparent from the following description.

SUMMARY OF THE INVENTION

The invention provides a method for reducing fouling of heated surfaces, especially during petrochemical or refinery processing, by preparing hydrocarbon oil compositions by dissolving or dispersing in said oil compositions an additive comprising: (1) at least one aluminum compound and at least one thiadiazole compound, (2) at least one aluminum compound, at least one thiadiazole compound and at least one compound containing ionizable hydrogen, (3) at least one aluminum compound and at least one triazole compound, (4) at least one aluminum compound and at least one compound containing ionizable hydrogen, (5) at least one thiadiazole compound, or (6) at least one triazole compound. The method and composition can be employed with heat exchange equipment at relatively high temperatures.

DETAILED DESCRIPTION OF THE INVENTION

The present invention may be applied to any hydrocarbon process wherein an oil which tends to foul metal surfaces is contacted by the oil at an elevated temperature. In general, such hydrocarbon oils include petroleum crude oils, syncrude oils, shale oils, oils from bituminous sands and refined fractions thereof, and all other hydrocarbons which typically deposit foulants when heated to temperatures above about 250° F. The invention is particularly applicable to oils in which at least about 50 weight percent of the oil boils above about 500° F., as for example, a diesel, a gas oil, or a heavy vacuum gas oil. The invention is most often employed with those heavy oils in which at least 50 weight percent of the oil normally boils above about 850° F. such as atmospheric or vacuum residua and viscous pitches. The invention is employed particularly with feedstocks which charactertically deposit large amounts of foulants during distillation or other processing, such as those passing through furnaces and heaters of cokers, visbreaking units and crude oil units. However, the invention is also applicable to those fractions of hydrocarbon oils used in the petrochemical industry.

It is preferred that the hydrocarbon oil be substantially anhydrous. A "substantially anhydrous" hydrocarbon as used herein refers to hydrocarbon oil compositions containing up to that amount of water soluble in the oil at atmospheric conditions. Ordinarily, the amount of water soluble in the hydrocarbon oil is less than 5, usually less than 1, and most usually less than 0.1 weight percent. In some cases, the processing of non-anhydrous hydrocarbon oil compositions in the invention detrimentally affects the rate of fouling; thus, it is highly preferred that non-anhydrous hydrocarbon oils be pretreated for water removal, as by distillation, decantation, and the like.

According to the present invention, one or more antifoulant additive compounds are combined with the hydrocarbon oil, thus producing a composition having a reduced tendency for fouling at elevated temperatures. The antifoulant additives used herein are aluminum compounds, thiadiazole compounds, triazole compounds, compounds containing ionizable hydrogen, and combinations thereof. The antifoulant additives utilized in the present invention must be at least dispersable in the oil, and preferably are soluble in the hydrocarbon oil. In one embodiment at least one thiadiazole compound is combined with a hydrocarbon oil. In another embodiment at least one aluminum compound and at least one thiadiazole compound are combined with the oil. A highly preferred embodiment includes at least one aluminum compound, at least one thiadiazole compound and at least one compound containing ionizable hydrogen combined with the oil. Another embodiment includes at least one aluminum compound and at least one compound containing ionizable hydrogen combined with the oil.

Another group of antifoulant additives of the invention includes at least one triazole compound combined with the hydrocarbon oil. A preferred embodiment includes at least one triazole compound and at least one aluminum compound combined with the oil. Another embodiment includes at least one triazole compound, at least one aluminum compound at at least one compound containing ionizable hydrogen combined with the oil.

Any suitable form of aluminum compounds may be utilized with the other antifoulant additives of the invention. Inorganic aluminum compounds and organic aluminum compounds, as well as mixtures of any two or more thereof, are suitable sources of aluminum. Organic aluminum compounds that are essentially soluble in the hydrocarbon oil are highly preferred. The term "aluminum compound" generally refers to any of the aluminum sources.

Examples of inorganic aluminum compounds that can be used are aluminum sulfide, aluminum tri-isocyanate, aluminum phosphide, aluminum antimonide (AlSb), aluminum borate, aluminum nitrate, aluminum sulfate, and aluminum dihydrogen phosphate.

Examples of organic aluminum compounds that can be used are: aluminum isopropylate, aluminum tri (s-butoxide), aluminum di (s-butoxide) acetoacetic ester chelate, 2,6 dimethylamino-4-nonylphenol-N,N'-di-(2-hydroxyl-5-nonylbenzl)-N,N'diacetic acid aluminum salt, aluminum 2-ethylhexanoate, aluminum benzoylacetonate, aluminum acetylacetonate, aluminum acetate, aluminum ethoxide, aluminum lactate, aluminum formate, aluminum hydroxy cyclohexanebutyrate, aluminum oleate, aluminum stearate, aluminum oxalate, tri-i-butyaluminum $Al(C_8H_9)_3$, tri-n-hexylaluminum $Al(C_6H_{13})_3$, trimethylaluminum $Al(CH_3)_3$, aluminum formate, aluminum hexanoate, aluminum octoate, aluminum decanoate, aluminum n-butoxide, aluminum n-pentoxide, trimethylaluminum $[(CH_3)_6Al_2]$, triethylaluminum, $[(C_2H_5)_6Al_2]$, triisobutylaluminum, triphenylaluminum $[(Ph_3Al)_2]$, monoethylaluminum hydride, and diphenylaluminum hydride. The most highly preferred aluminum compound is aluminum isopropylate.

Any suitable form of a thiadiazole compound may be utilized alone, or with the other antifoulant additives of the invention. Examples of suitable thiadiazole compounds include thiadiazole, 2,5 dimercapto-1,3,4-thiadiazole, 5-amino-3 phenyl-1,2,4-thiadiazole, 2,5-dimethyl-1,3,4-thiadiazole, normal-butyl-5-para-toluenesulfonamido-1,3,4-thiadiazole, 2-isobutyl-5-para-toluenesulfonamido-1,3,4-thiadiazole, 2-amino-5-hexadecylthio-1,3,4-thiadiazole, 2-amino-1,3,4-thiadiazole, 2,5-bis-(methylthio)-1,3,4-thiadiazole, 5-methyl-1,3,4-thiadiazole-2-thiol, 2-methylthio-4-phenyl-5-phenylimino-1,3,4-thiadiazol-2-ine, 5-(para-toluidino)-1,3,4-thiadiazole-2(3H)-thione, 2-(ortho-toluidino)-1,3,4-thiadiazol-2-ine-5-thione, 5-cyclohexylamino-1,3,4-thiadiazole-2(3H)-thione, 2-(methylthio)-5-(p-tolyl)-1,3,4-thiadiazole, 3-amino-1-(5-phenyl-1,3,4-thiadiazol-2-ylmethyl)-2-pyrazolin-5-one, 1-(4-butoxyphenyl)-3-(5-methyl-1,3,4-thiadiazol-2-yl)urea, 4-amino-2,1,3-benzothiadiazole, 5-amino-1,3,4-thiadiazole-2-thiol, 2-amino-5-methyl-1,3,4-thiadiazole, 2-amino-5-ethyl-1,3,4-thiazole, 2-acetamido-5-benzylthio-1,3,4-thiadiazole, 2,1,3-benzothiadiazole, 2,5-bis-(4-pyridyl)-1,3,4-thiadiazole, and 4-nitro-2,1,3-benzothiadiazole (4-nitro-piazthiole).

Any suitable form of a triazole compound may be utilized alone, or with the other antifoulant additives of the invention. Examples of suitable triazole compounds include tolyltriazole ($C_7H_7N_3$), 4-amino-3-hydrazino-5-mercapto-1,2,4-triazole, 3-amino-5-mercapto-1,2,4-triazole, 3-amino-1,2,4-triazole, 3,5-diamino-1,2,4-triazole, 4,5-dicarboxyl-1,2,3-triazole, 1-hydroxybenzotriazole, N-mesitylenesulfonyl-1,2,4-triazole, 1,2,3-triazole, 1,2,4-triazole, and benzotriazole.

The antifoulant additive compound of the invention containing ionizable hydrogen is typically an acidic material capable of donating a hydrogen ion species. Suitable forms of such materials include inorganic acids, organic acids, and acid derivatives thereof. Preferably the acidic compound is added to the hydrocarbon oil in a concentration that effects essentially no corrosion of the heated metallic surfaces.

Examples of compounds containing ionizable hydrogen include formic acid, acetic acid, oxalic acid, butyric acid, capric acid, butinoic acid, tetrolic acid, mono or di organic acid derivatives of boric acid, benzoic acid, phenol, picric acid, hydroquinone, resorcinol, cathechol, pyrogallol, nonylphenol, polyisobutyene phenol, 2-6 di-t-butyl phenol, benzene sulfonic acid, naphthalene sulfonic acid, and mono or di organic acid derivatives of phosphoric acid. The most highly preferred compound containing ionizable hydrogen is formic acid.

Other chemical additives in combination with the aforementioned antifoulant additives may be utilized in the compositions and method of the invention. For instance, oil-soluble derivatives of azole and diazole compounds may be admixed with one or more of the aforementioned additives and a hydrocarbon oil to produce a composition having a reduced tendency for fouling. Preferred derivative compounds include diazole compounds such as 3-amino-4-carbethoxypyrazole, 3-methylpyrazole, N-nitropyrazole, 1,3,5-trimethylpyrazole, 2-aminobenzimidazole, 5-amino-3-methylisoxazole, N-(3-aminoproyl) imidazole, 5-aminotetrazole, benzimidazole, 4,5, benzisoxazole, N-benzoylimidazole, 4-benzylidene-2-methyloxazol-5-one, N-t-butoxycarbonylimidazole, t-butyl-α-oxo-1H-imidiazole-1-acetate, N-trans-cinnamoylimidazole, 2,5 dephenyloxazole, imidazole, 2-isopropylimidazole, isoxazole, 2-mercaptoimidazole, and azole compounds such as 2-aminobenzothiazole, 6-aminobenzothiazole, 2-amino-4-methylthiazole, 2-amino-5-nitrothiazole, benzothiazole, 2-mercapto-4-phyenylthiazole, propoxylated dimethyl pyrazole, and ethoxylated dimethyl pyrazole.

The foulant-inhibiting amounts of antifoulant additives utilized in the present invention, i.e., the aluminum compound, the thiadiazole compound, the triazole combined with the hydrocarbon oil, whether dissolved alone or in combination with each other, or other additive chemicals, will depend upon the degree to which the oil tends to deposit foulants at the temperature to which it is heated. At elevated temperatures, such as greater than 250° F., the hydrocarbon oil composition contacting a heated surface will typically exhibit a reduced rate of fouling when containing a foulant-inhibiting amount of at least one aluminum compound in a concentration, usually about 0.05 ppmw to about 1,000 ppmw, preferably from about 0.1 ppmw to about 50 ppmw, and more preferably about 1 ppmw to about 25 ppmw. Fouling of heated surfaces may be reduced when as little as 0.1 to 15 ppmw of at least one aluminum compound in combination with foulant-inhibiting amounts of the other aforementioned additives is dissolved in hydrocarbon oils having been heated to temperatures between about 300° F. and about 1,350° F. Such temperatures are a result of the hydrocarbon oil compositions of this invention typically being contacted with surfaces heated to temperatures from about 300° F. to about 2,000° F.

The hydrocarbon oil composition contacting a heated surface will usually exhibit a reduced rate of fouling when containing foulant-inhibiting amounts of either a triazole or thiadiazole compound in a concentration from about 1 ppmw to about 1,200 ppmw, preferably from about 5 ppmw to about 500 ppmw, and more preferably about 10 ppmw to about 400 ppmw.

The relative amounts of the antifoulant additives in the embodiments of the invention will depend upon the degree to which the oil deposits foulants at the temperature to which it is heated. Ordinarily, the mole ratio of ionizable hydrogen, calculated as H, contained in compounds containing ionizable hydrogen to aluminum, calculated as Al, contained in the aluminum compounds, is in the range from about 30:1 to about 0.1:1, and preferably from about 20:1 to about 1:1. Also, the mole ratio of thiadiazole or triazole, contained in the thiadiazole or triazole compounds to the aluminum, calculated as Al, contained in the aluminum compounds, is in the range from about 6:1 to about 0.01:1, preferably in the range from about 4:1 to about 0.05:1, and most preferably in the range from about 3:1 to about 0.1:1.

For example, a typical weight ratio of formic acid to aluminum isopropylate is in the range from about 20:1 to 40:1, and preferably about 25:1 to about 35:1. When 2,5-dimercapto-1,3,4-thiadiazole is added to the aforementioned combination of additives, the typical weight ratio of the thiadiazole compound to the aluminum in the aluminum compound is about 10:1 to about 1:1, and preferably about 7:1 to about 3:1. In a combination of aluminum and thiadiazole with formic acid, the typical weight ratio of thiadiazole to aluminum is greater than that in the absence of formic acid or other compounds containing ionizable hydrogen. In other words, the weight of aluminum required to reduce fouling in the presence of formic acid is less than the weight of aluminum required to reduce fouling in the absence of formic acid.

In the presence or absence of an antifoulant additive, a particular hydrocarbon oil typically begins fouling a metallic surface when heated above a threshold temperature, which herein is termed the "incipient fouling temperature." At this temperature and higher, fouling of heated surfaces will occur and is manifested by a weight increase on the surfaces due to deposition of foulant materials. Although the invention is not to be held to any particular theory of operation, it is believed that the results obtained in the invention are at least in part due to compositions containing antifoulant additives of the invention that deposit foulant materials of better heat transfer characteristics than foulant materials from the same hydrocarbon oils but not containing an additive or additives of the invention.

Ordinarily the invention is employed with a hydrocarbon oil having an incipient fouling temperature above about 250° F., preferably above about 500° F. and more preferably, above about 850° F. When in contact with a heated surface at the incipient fouling temperature, a hydrocarbon oil containing an antifoulant additive of the invention, or combination thereof, exhibits better heat transfer efficiency than one without an additive. For example, a residuum hydrocarbon oil or a naphtha-containing oil, both containing an antifoulant additive of the invention at their respective incipient fouling temperatures of 1,000° F. and 600° F., exhibit better heat transfer efficiencies in contact with a heated surface than their counterparts without such antifoulant additives.

Fouling may be measured by the heat transfer efficiency of a heated surface contacting the hydrocarbon oil at the incipient fouling temperature. During a given contacting time period, the oil-contacting surface will gradually become fouled, necessitating an increase in surface temperature with increased fouling to maintain the oil composition at a given temperature. The temperature increase requirement (TIR) value (calculated in °F. per given time period) of the oil-contacting surface represents the net increase in surface temperature over a given period of time to maintain the oil composition at a given temperature. A large TIR value is indicative of low heat transfer efficiency and substantial fouling of the heated surface. Whether a TIR value is considered large or small will depend upon acceptable fouling rates in a particular application. For instance, as little as a 1° F. improvement in TIR value may significantly reduce the operating energy requirements in refinery or petrochemical processing equipment, saving, for example, between about 2 and 4 million BTU's per day in a visbreaking unit processing 20,000 barrel per day.

Fouling of a heated metal surface is substantially reduced by employing the compositions of the invention. TIR values associated with surfaces contacted with a composition of the invention containing a hydrocarbon oil and antifoulant additive of the invention, or combinations thereof, are substantially smaller under comparative conditions than that for the same hydrocarbon oil containing no antifoulant additive. Consequently, comparative TIR ratios (TIR of oil alone minus TIR of oil plus additive/TIR of oil alone) indicate that substantially reduced, often by at least about 25 percent, and preferably at least about 50 percent.

In the method of the invention, an antifoulant material containing one or more antifoulant additives of the invention is dissolved in a hydrocarbon oil to produce a composition having a reduced tendency for fouling at elevated temperatures. Typically, the antifoulant additive material is introduced into a hydrocarbon oil stream at a location in the processing scheme immediately ahead of the heat exchange surface where reduced fouling is desired. The antifoulant additive material is usually admixed with the oil in any manner resulting in contact of the heated surface with the antifoulant-containing oil homogeneously dispersed or dissolved in proportions disclosed hereinbefore. The additives are often first dissolved in a liquid carrier material and subsequently added to the hydrocarbon oil. Such liquid carrier materials include solvents that are soluble in the particular hydrocarbon oil being treated. Light hydrocarbon-containing solvents and aromatic hydrocarbon-containing solvents are commonly employed as carriers. Typical solvents include kerosene, alcohol, toluene, xylene, benzene, decane, isooctane and pentane.

The invention is further illustrated by the following examples which are illustrative of specific modes of practicing the invention and are not intended as limiting the scope of the appended claims.

EXAMPLE I

Hydrocarbon oil compositions of the invention and control compositions are prepared for testing by admixing different amounts of antifoulant additives with five similar residuum hydrocarbon fractions (herein designated as A through E) obtained from feedstocks to commercial coking or visbreaking petroleum processing units.

Mixtures containing various combinations of aluminum tri (s-butoxide), aluminum isopropylate, 2,5-dimercapto-1,3,4-thiadiazole, 2,5-dimethyl-1,3,4-thiadiazole, tolyltriazole and formic acid are dissolved in kerosene and added to one-liter samples of residuum fractions, A through E, in sufficient concentration so as to produce final composition Nos. 1 through 18 according to Table I. Dissolved in residuum fraction A, formic acid is present in increasing concentrations in composition Nos. 1 through 5, respectively, while the concentration of aluminum isopropylate is held constant. In the preparation of composition Nos. 6 through 9, containing residuum fraction B, 2,5-dimercapto-1,3,4-thiadiazole is present in decreasing concentrations while the concentrations of aluminum isopropylate and formic acid are held constant (and in an Al/acid weight ratio of 30:1).

In the preparation of compositions, Nos. 10 through 14, 2,5-dimercapto-1,3,4-thiadiazole (comp. 10), 5-amino-3 phenyl-1,2,4-thiadiazole (comps. 11–13) and 2,5-dimethyl-1,3,4-thiadiazole (comp. 14) are added to one-liter samples of the residuum fraction C in sufficient concentration to produce compositions set forth in TABLE I. Composition No. 15 is prepared from a one-liter sample of the residuum fraction D to which is added antifoulant additives including aluminum isopropylate and tolytriazole in concentrations set forth in TABLE I.

In the preparation of compositions Nos. 16 through 18, the residuum fraction E and aluminum tri (s-butoxide) or aluminum tri (s-butoxide) and 2,5-dimercapto-1,3,4-thiadiazole compounds are dissolved in kerosene and added in a concentration sufficient to produce the hydrocarbon oil compositions set forth in Table I.

EXAMPLE II

A commercial accelerated fouling test apparatus is utilized in this Example. The apparatus is the THERMAL FOULING TESTER, Model No. TFT212B marketed by Alcor, Inc. Such an apparatus comprises a fuel reservoir with a piston and seal to accommodate feedstock and effluent, a nitrogen pressurizing system, a variable speed pump to control flow of feedstock to the heater section, and a heater section which contains an electrically heated annular single tube heat exchanger through which the feedstock flows and is heated to test temperatures. A thermocouple measures the outlet temperature of the feedstock and actuates a temperature controller to maintain a constant outlet temperature of the feedstock. This action increases the interior tube surface temperature to maintain the proper amount of heat to be transferred to the feedstock. A thermocouple located inside the tube heat exchanger measures the temperature of the interior surface of the tube. The entire system is closed and pressurized with nitrogen to prevent the ingression of air, water, and other contaminants.

Control feedstocks from Example I (feedstocks A through E), containing no antifoulant additive, are sparged with helium for about 30 minutes to remove air (oxygen) during the preheat operation to about 150° F. and introduced into a stainless steel tube heat exchanger at 500 p.s.i.g. and at a rate of 3.3 ml/minute. As the feedstock travels through the tube heat exchanger, it is heated to progressively increasing temperatures ranging from about 150° F. to 850° F. The temperature of the feedstock leaving the tube heat exchanger is maintained at 850° F. for three hours. In order to maintain an output temperature of the feedstock at 850° F., control of the interior surface of the tube heat exchanger is initially at a temperature of at least 1,000° F. At this tube surface temperature, the feedstock degrades (i.e. fouls) as it passes through the tube, forming particles which tend to adhere to the inside surface of the tube heat exchanger and thereby increase the weight of the tube. During the three hour test, the temperature of the interior surface of the tube exchanger is gradually increased, as required, above the initial 1,000° F. temperature in order to maintain the output feedstock temperature at 850° F. The temperature increase requirements over the three hour period (TIR) are 81° F., 75° F., 110° F., 49° F. and 122° F., for residuum fractions A through E, respectively.

In addition to the control feedstock, Compositions Nos. 1 through 18 from Example I are tested in a similar manner and the results summarized in TABLE I. The percent reduction in fouling is calculated from a ratio of TIR values of each composition as compared to the controls. Additionally, a percent reduction in fouling based upon weight gain of the tube for each composition is compared to the weight gain of the controls.

TABLE I

| | ANTIFOULANT CONCENTRATION, PPMW | | | | | |
|---|---|---|---|---|---|---|
| Composition No. | aluminum isopropylate | 2,5-dimercapto-1,3,4 thiadiazole | 5-amino-3 phenyl-1,2,4 thiadiazole | formic acid | 2,5-dimethyl-1,3,4 thiadiazole | TIR °F. (of tube) |
| Control A | — | — | — | — | — | 81 |
| 1 | 19 | — | — | 190 | — | 106 |
| 2 | 19 | — | — | 380 | — | 37 |
| 3 | 19 | — | — | 475 | — | 58 |

TABLE I-continued

| | | | | | | |
|---|---|---|---|---|---|---|
| 4 | 19 | — | — | 570 | — | 70 |
| 5 | 19 | — | — | 760 | — | 86 |
| Control B | — | — | — | — | — | 75 |
| 6 | 25 | 250 | | 750 | — | 68 |
| 7 | 25 | 125 | — | 750 | — | 38 |
| 8 | 25 | 100 | — | 750 | — | 56 |
| 9 | 25 | 62 | — | 750 | — | 76 |
| Control C | — | — | — | — | — | 110 |
| 10 | — | 500 | — | — | — | 79 |
| 11 | — | — | 1,000 | — | — | 52 |
| 12 | — | — | 500 | — | — | 76 |
| 13 | — | — | 250 | — | — | 80 |
| 14 | — | — | — | — | 1,000 | 64 |
| | | tolyltriazole | | | | |
| Control D | — | — | — | — | — | 49 |
| 15 | 25 | 150 | — | — | — | 25 |

| Composition No. | $\frac{(\text{TIR °F. control} - \text{TIR °F. comp.})}{\text{TIR °F. control}} \times 100$ Percent Reduction in Fouling | weight gain (of tube) grams | $\frac{(\text{weight gain control} - \text{weight gain comp.})}{\text{weight gain control}} \times 100$ Percent Reduction in Fouling |
|---|---|---|---|
| Control A | — | 0.143 | — |
| 1 | no red | 0.112 | 22 |
| 2 | 54 | 0.070 | 51 |
| 3 | 28 | 0.079 | 45 |
| 4 | 14 | 0.191 | 36 |
| 5 | no red | 0.090 | 37 |
| Control B | — | 0.100 | — |
| 6 | 9 | 0.080 | 20 |
| 7 | 49 | 0.043 | 57 |
| 8 | 25 | 0.067 | 33 |
| 9 | no red | 0.056 | 44 |
| Control C | — | 0.1255 | — |
| 10 | 28 | 0.0713 | 43 |
| 11 | 53 | 0.0417 | 67 |
| 12 | 31 | 0.0653 | 48 |
| 13 | 27 | 0.0752 | 40 |
| 14 | 42 | 0.0690 | 45 |
| Control D | — | 0.334 | — |
| 15 | 49 | 0.0179 | 46 |

| | ANTIFOULANT CONCENTRATION, PPMW | | | | | |
|---|---|---|---|---|---|---|
| Composition No. | aluminum tri (s-butoxide) | 2,5-dimercapto-1,3,4 thiadiazole | 5-amino-3 phenyl-1,2,4 thiadiazole | formic acid | 2,5-dimethyl-1,3,4 thiadiazole | TIR °F. (of tube) |
| Control E | — | — | — | — | — | 122 |
| 16 | 188 | — | — | — | — | 93 |
| 17 | 188 | 125 | — | — | — | 73 |
| 18 | 94 | 63 | — | — | — | 71 |

| Composition No. | $\frac{(\text{TIR °F. control} - \text{TIR °F. comp.})}{\text{TIR °F. control}} \times 100$ Percent Reduction in Fouling | weight gain (of tube) grams | $\frac{(\text{weight gain control} - \text{weight gain comp.})}{\text{weight gain control}} \times 100$ Percent Reduction in Fouling |
|---|---|---|---|
| Control E | — | 0.1356 | — |
| 16 | 24 | 0.0436 | 68 |
| 17 | 40 | 0.0481 | 65 |
| 18 | 42 | 0.0554 | 59 |

In view of the data in TABLE I, composition Nos. 1 through 18, all of which contain an additive or combination of additives of the invention, demonstrate a reduced tendency for fouling as compared to their respective controls for residuum feedstocks A through E. As the concentration of formic acid increases in composition Nos. 1 through No. 5 from 180 ppmw to 760 ppmw (i.e. the weight or mole ratio of ionizable hydrogen in formic acid to aluminum increases), the percent reduction in fouling temperature is substantial when the formic acid to aluminum weight ratio is in the range from about 20:1 to about 30:1 More particuarly, composition No. 2 demonstrates greater than a 50 percent reduction in both fouling temperature and weight gain as compared to the controls.

Composition Nos. 6 through 9, and particularly composition 7, containing aluminum and formic acid (weight ratio 30:1) in combination with a thiadiazole compound, exhibit a substantial effect on the reduction of fouling temperature and weight gain.

Composition Nos. 10 through 18, containing various aluminum, thiadiazole, aluminum/thiadiazole, and aluminum/triazole compounds in the residuum fractions C and E, demonstrate considerable reduction in fouling compared to the control. For instance, composition Nos. 11, 14, 15, 17 and 18, all demonstrate at least 40 percent reduction in both fouling temperature and weight gain as compared to the controls.

Although particular embodiments of the invention have been described, it will be understood, of course, that the invention is not limited thereto since many obvious modifications can be made, and it is intended to include within this invention any such modifications as will fall within the scope of the appended claims.

I claim:

1. A method comprising reducing fouling of heated surfaces contacted with a hydrocarbon oil during petrochemical or refinery processing thereof by adding to said hydrocarbon oil a foulant-inhibiting amount of an additive comprising at least one aluminum compound and at least one thiadiazole compound.

2. The method defined in claim 1 wherein said aluminum compound is selected from the group consisting of aluminum isopropylate [$Al(OC_3H_7)_3$], aluminum tri (s-butoxide), aluminum di (s-butoxide) acetoacetic ester chelate, 2,6 dimethylamino-4-nonylphenol-N,N'-di(2-hydroxyl-5-nonylbenzl)-N,N'diacetic acid aluminum salt, aluminum 2-ethylhexanoate, aluminum benzoylacetonate, aluminum acetylacetonate, aluminum acetate, aluminum ethoxide, aluminum lactate, aluminum formate, aluminum hydroxy cyclohexanebutyrate, aluminum oleate, aluminum stearate, aluminum oxalate, tri-i-butyaluminum $Al(C_8H_9)_3$, tri-n-hexylaluminum $Al(C_6H_{13})_3$, trimethylaluminum $Al(CH_3)_3$, aluminum formate, aluminum hexanoate, aluminum octoate, aluminum decanoate, aluminum n-butoxide, aluminum n-pentoxide, trimethylaluminum [$(CH_3)_6Al_2$], triethylaluminum [$(C_2H_5)_6Al_2$], triisobutylaluminum, triphenylaluminum [$(Ph_3Al)_2$], monoethylaluminum hydride, and diphenylaluminum hydride.

3. The method defined in claim 1 wherein said thiadiazole compound is selected from the group consisting of thiadiazole, 2,5 dimercapto-1,3,4-thiadiazole, 5-amino-3 phenyl-1,2,4-thiadiazole, 2,5-dimethyl-1,3,4-thiadiazole, normal-butyl-5-para-toluenesulfonamido-1,3,4-thiadiazole, 2-isobutyl-5-para-toluenesulfonamido-1,3,4-thiadiazole, 2-amino-5-hexadecylthio-1,3,4-thiadiazole, 2-amino-1,3,4-thiadiazole, 2,5-bis-(methylthio)-1,3,4-thiadiazole, 5-methyl-1,3,4-thiadiazole-2-thiol, 2-methylthio-4-phenyl-5-phenylimino-1,3,4-thiadiazol-2-ine, 5-(para-toluidino)-1,3,4-thiadiazole-2(3H)-thione, 2-(ortho-toluidino)-1,3,4-thiadiazol-2-ine-5-thione, 5-cyclohexylamino-1,3,4-thiadiazole-2(3H)-thione, 2-(methylthio)-5-(p-tolyl)-1,3,4-thiadiazole, 3-amino-1-(5-phenyl-1,3,4-thiadiazol-2-ylmethyl)-2-pyrazolin-5-one, 1-(4-butoxyphenyl)-3-(5-methyl-1,3,4-thiadiazol-2-yl)urea, 4-amino-2,1,3-benzothiadiazole, 5-amino-1,3,4-thiadiazole-2-thiol, 2-amino-5-methyl-1,3,4-thiadiazole, 2-amino-5-ethyl-1,3,4-thiazole, 2-acetamido-5-benzylthio-1,3,4-thiadiazole, 2,1,3-benzothiadiazole, 5-bis-(4-pyridyl)-1,3,4-thiadiazole, and 4-nitro-2,1,3-benzothiadiazole (4-nitro-piazthiole).

4. The method defined in claim 1 wherein the mole ratio of thiadiazole contained in said thiadiazole compound to said aluminum, calculated as Al, in said aluminum compound is in the range from about 6:1 to about 0.01:1.

5. The method defined in claim 1 wherein said hydrocarbon oil contains about 0.1 ppmw to about 50 ppmw of aluminum, calculated as Al.

6. The method defined in claim 1 wherein said hydrocarbon oil contains about 1 ppmw to about 1,200 ppmw of said thiadiazole compound.

7. A method for reducing fouling of heated surfaces contacted with a hydrocarbon oil during petrochemical or refinery processing thereof, said method comprising the step of contacting a hydrocarbon oil with said surfaces during said petrochemical or refinery processing, said hydrocarbon oil containing a foulant-inhibiting amount of an additive comprising at least one aluminum coupound, at least one thiadiazole compound and at least one compound in addition to said thiadiazole compound that contains ionizable hydrogen.

8. The method defined in claim 7 wherein said compound containing ionizable hydrogen is selected from the group consisting of formic acid, acetic acid, oxalic acid, butyric acid, capric acid, butinoic acid, tetrolic acid, mono or di organic acid derivatives of boric acid, benzoic acid, phenol, picric acid, hydroquinone, resorcinol, cathechol, pyrogallol, nonylphenol, polyisobutyene phenol, 2-6 di-t-butyl phenol, benzene sulfonic acid, naphthalene sulfonic acid, and mono or di organic acid derivatives of phosphoric acid.

9. The method defined in claim 7 wherein said aluminum compound is selected from the group consisting of aluminum isopropylate [$Al(OC_3H_7)_3$], aluminum tri (s-butoxide), aluminum di (s-butoxide) acetoacetic ester chelate, 2,6 dimethylamino-4-nonylphenol-N,N'-di(2-hydroxyl-5-nonylbenzl)-N,N'diacetic acid aluminum salt, aluminum 2-ethylhexanoate, aluminum benzoylacetonate, aluminum acetylacetonate, aluminum acetate, aluminum ethoxide, aluminum lactate, aluminum formate, aluminum hydroxy cyclohexanebutyrate, aluminum oleate, aluminum stearate, aluminum oxalate, tri-i-butyaluminum $Al(C_8H_9)_3$, tri-n-hexylaluminum $Al(C_6H_{13})_3$, trimethylaluminum $Al(CH_3)_3$, aluminum formate, aluminum hexanoate, aluminum octoate, aluminum decanoate, aluminum n-butoxide, aluminum n-pentoxide, trimethylaluminum [$(CH_3)_6Al_2$], triethylaluminum [$(C_2H_5)_6Al_2$], triisobutylaluminum, triphenylaluminum [$(Ph_3Al)_2$], monoethylaluminum hydride, and diphenylaluminum hydride.

10. The method defined in claim 7 wherein said thiadiazole compound is selected from the group consisting of thiadiazole, 2,5 dimercapto-1,3,4-thiadiazole, 5-amino-3- phenyl-1,2,4-thiadiazole, 2,5-dimethyl-1,3,4-thiadiazole, normal-butyl-5-para-toluenesulfonamido-1,3,4-thiadiazole, 2-isobutyl-5-para-toluenesulfonamido-1,3,4-thiadiazole, 2-amino-5-hexadecylthio-1,3,4-thiadiazole, 2-amino-1,3,4-thiadiazole, 2,5-bis-(methylthio)-1,3,4-thiadiazole, 5-methyl-1,3,4-thiadiazole-2-thiol, 2-methylthio-4-phenyl-5-phenylimino-1,3,4-thiadiazol-2-ine, 5-(para-toluidino)-1,3,4-thiadiazole-2(3H)-thione, 2-(ortho-toluidino)-1,3,4-thiadiazol-2-ine-5-thione, 5-cyclohexylamino-1,3,4-thiadiazole-2(3H)-thione, 2-(methylthio)-5-(p-tolyl)-1,3,4-thiadiazole, 3-amino-1-(5-phenyl-1,3,4-thiadiazol-2-ylmethyl)-2-pyrazolin-5-one, 1-(4-butoxyphenyl)-3-(5-methyl-1,3,4-thiadiazol-2-yl)urea, 4-amino-2,1,3-benzothiadiazole, 5-amino-1,3,4-thiadiazole-2-thiol, 2-amino-5-methyl-1,3,4-thiadiazole, 2-amino-5-ethyl-1,3,4-thiazole, 2-acetamido-5-benzylthio-1,3,4-thiadiazole, 2,1,3-benzothiadiazole, 2,5-bis-(4-pyridyl)-1,3,4-thiadiazole, and 4-nitro-2,1,3-benzothiadiazole (4-nitro-piazthiole).

11. The method defined in claim 7 wherein the mole ratio of ionizable hydrogen, calculated as H, in said compound containing ionizable hydrogen to said aluminum, calculated as Al, contained in said aluminum compound is in the range from about 30:1 to about 0.1:1.

12. The method defined in claim 7 wherein the mole ratio of thiadiazole contained in said thiadiazole compound to said aluminum, calculated as Al, in said aluminum compound is in the range from about 6:1 to about 0.01:1.

13. The method defined in claim 7 wherein said hydrocarbon oil contains about 0.1 ppmw to about 50 ppmw of aluminum, calculated as Al.

14. The method defined in claim 7 wherein said hydrocarbon oil contains about 1 ppmw to about 1,200 ppmw of said thiadiazole compound.

15. A method comprising reducing fouling of heated surfaces contacted with a hydrocarbon oil during petrochemical or refinery processing thereof by adding to said hydrocarbon oil a foulant-inhibiting amount of an additive comprising at least one aluminum compound and at least one triazole compound and wherein the mole ratio of triazole contained in said triazole compound to said aluminum, calculated as Al, in said aluminum compound is in the range from about 6:1 to about 0.01:1.

16. The method defined in claim 15 wherein said aluminum compound is selected from the group consisting of aluminum isopropylate [$Al(OC_3H_7)_3$], aluminum tri (s-butoxide), aluminum di (s-butoxide) acetoacetic ester chelate, 2,6 dimethylamino-4-nonylphenol-N,N'-di(2-hydroxyl-5-nonylbenzl)-N,N'diacetic acid aluminum salt, aluminum 2-ethylhexanoate, aluminum benzoylacetonate, aluminum acetylacetonate, aluminum acetate aluminum ethoxide, aluminum lactate, aluminum formate, aluminum hydroxy cyclohexanebutyrate, aluminum oleate, aluminum stearate, aluminum oxalate, tri-i-butyaluminum $Al(C_8H_9)_3$, tri-n-hexylaluminum $Al(C_6H_{13})_3$, trimethylaluminum $Al(CH_3)_3$, aluminum formate, aluminum hexanoate, aluminum octoate, aluminum decanoate, aluminum n-butoxide, aluminum n-pentoxide, aluminum acetylacetonate, trimethylaluminum [$(CH_3)_6Al_2$], triethylaluminum [$(C_2H_5)_6Al_2$], triisobutylaluminum, triphenylaluminum [$(Ph_3Al)_2$], monoethylaluminum hydride, and diphenylaluminum hydride.

17. The method defined in claim 15 wherein said triazole compound is selected from the group consisting of tolyltriazole ($C_7H_7N_3$), 4-amino-3-hydrazino-5-mercapto-1,2,4-triazole, 3-amino-5-mercapto-1,2,4-triazole, 3-amino-1,2,4-triazole, 3,5-diamino-1,2,4-triazole, 4,5-dicarboxyl-1,2,3-triazole, and benzotriazole.

18. The method defined in claim 15 further comprising at least one compound in addition to said triazole compound that contains ionizable hydrogen.

19. The method defined in claim 18 wherein said compound containing ionizable hydrogen is selected from the group consisting of formic acid, acetic acid, oxalic acid, butyric acid, capric acid, butinoic acid, tetrolic acid, mono or di organic acid derivatives of boric acid, benzoic acid, phenol, picric acid, hydroquinone, resorcinol, cathechol, pyrogallol, nonylphenol, polyisobutyene phenol, 2-6 di-t-butyl phenol, benzene sulfonic acid, naphthalene sulfonic acid, and mono or di organic acid derivatives of phosphoric acid.

20. The method defined in claim 15 wherein said hydrocarbon oil contains about 0.1 ppmw to about 50 ppmw of aluminum, calculated as Al.

21. The method defined in claim 15 wherein said hydrocarbon oil contains about 1 ppmw to about 1,200 ppmw of said triazole compound.

22. A method comprising reducing fouling of heated surfaces contacted with a hydrocarbon oil during refinery or petrochemical processing thereof by adding to said hydrocarbon oil a foulant-inhibiting amount of an additive comprising at least one aluminum compound and at least one compound containing ionizable hydrogen and wherein the mole ratio of ionizable hydrogen, calculated as H, in said compound containing ionizable hydrogen to said aluminum, calculated as Al, contained in said aluminum compound, is in the range from about 30:1 to about 0.01:1.

23. The method defined in claim 22 wherein said aluminum compound is selected from the group consisting of aluminum isopropylate [$Al(OC_3H_7)_3$], aluminum tri (s-butoxide), aluminum di (s-butoxide) acetoacetic ester chelate, 2,6 dimethylamino-4-nonylphenol-N,N'-di(2-hydroxyl-5-nonylbenzl)-N,N'diacetic acid aluminum salt, aluminum 2-ethylhexanoate, aluminum benzoylacetonate, aluminum acetylacetonate, aluminum acetate, aluminum ethoxide, aluminum lactate, aluminum formate, aluminum hydroxy cyclohexanebutyrate, aluminum oleate, aluminum stearate, aluminum oxalate, tri-i-butyaluminum $Al(C_8H_9)_3$, tri-n-hexylaluminum $Al(C_6H_{13})_3$, trimethylaluminum $Al(CH_3)_3$, aluminum formate, aluminum hexanoate, aluminum octoate, aluminum decanoate, aluminum n-butoxide, aluminum n-pentoxide, trimethylaluminum [$(CH_3)_6Al_2$], triethylaluminum [$(C_2H_5)_6Al_2$], triisobutylaluminum, triphenylaluminum [$(Ph_3Al)_2$], monoethylaluminum hydride, and diphenylaluminum hydride.

24. The method defined in claim 22 wherein said compound containing ionizable hydrogen is selected from the group consisting of formic acid, acetic acid, oxalic acid, butyric acid, capric acid, butinoic acid, tetrolic acid, mono or di organic acid derivatives of boric acid, benzoic acid, phenol, picric acid, hydroquinone, resorcinol, cathechol, pyrogallol, nonylphenol, polyisobutyene phenol, 2-6 di-t-butyl phenol, benzene sulfonic acid, naphthalene sulfonic acid, and mono or di organic acid derivatives of phosphoric acid.

25. A method comprising reducing heated surfaces contacted with a substantially anhydrous hydrocarbon oil during petrochemical or refinery processing thereof by adding to said hydrocarbon oil a foulant-inhibiting amount of an additive comprising at least one thiadiazole compound.

26. The method defined in claim 25 wherein said thiadiazole compound is selected from the group consisting of thiadiazole, 2,5 dimercapto-1,3,4-thiadiazole, 5-amino-3 phenyl-1,2,4-thiadiazole, 2,5-dimethyl-1,3,4-thiadiazole, normal-butyl-5-para-toluenesulfonamido-1,3,4-thiadiazole, 2-isobutyl-5-para-toluenesulfonamido-1,3,4-thiadiazole, 2-amino-5-hexadecylthio-1,3,4-thiadiazole, 2-amino-1,3,4-thiadiazole, 2,5-bis-(methylthio)-1,3,4-thiadiazole, 5-methyl-1,3,4-thiadiazole-2-thiol, 2-methylthio-4-phenyl-5-phenylimino-1,3,4-thiadiazol-2-ine, 5-(para-toluidino)-1,3,4-thiadiazole-2(3H)-thione, 2-(ortho-toluidino)-1,3,4-thiadiazol-2-ine-5-thione, 5-cyclohexylamino-1,3,4-thiadiazole-2(3H)-thione, 2-(methylthio)-5-(p-tolyl)-1,3,4-thiadiazole, 3-amino-1-(5-phenyl-1,3,4-thiadiazol-2-ylmethyl)-2-pyrazolin-5-one, 1-(4-butoxyphenyl)-3-(5-methyl-1,3,4-thiadiazol-2-yl)urea, 4-amino-2,1,3 -benzothiadiazole, 5-amino-1,3,4-thiadiazole-2-thiol, 2-amino-5-methyl-1,3,4-thiadiazole, 2-amino-5-ethyl-1,3,4-thiazole, 2-acetamido-5-benzylthio-1,3,4-thiadiazole, 2,1,3-benzothiazole, 2,5-bis-(4-pyridyl)-1,3,4-thiadiazole, and 4-nitro-2,1,3-benzothiadiazole (4-nitro-piazthiole).

* * * * *